United States Patent [19]

Lorge et al.

[11] Patent Number: 5,050,359

[45] Date of Patent: Sep. 24, 1991

[54] JOINT ADAPTABLE FOR USE IN A CLOSURE AND CLOSURE INCLUDING SUCH JOINT

[75] Inventors: Mark R. Lorge, Neenah; John T. Verch, Oshkosh, both of Wis.

[73] Assignee: Morgan Products Ltd., Oshkosh, Wis.

[21] Appl. No.: 521,078

[22] Filed: May 8, 1990

[51] Int. Cl.[5] ..... E06B 3/70

[52] U.S. Cl. ..... 52/456; 52/664; 52/507

[58] Field of Search ..... 52/664, 456, 507, 397, 52/456, 667, 468

[56] References Cited

U.S. PATENT DOCUMENTS 1,265,541 5/1918 Smith ..... 52/456

4,558,536 12/1985 Dunsmoor ..... 52/507 X 4,845,911 7/1989 Winston et al. ..... 52/456

*Primary Examiner*—David A. Scherbel

*Assistant Examiner*—Creighton Smith

*Attorney, Agent, or Firm*—Foley & Lardner

[57] ABSTRACT

A joint adaptable for use in a closure, and a closure employing such a joint, which joint comprises a first member and a second member, the first member substantially copingly fitting the second member in a joint footprint and establishing a boundary between the inside and outside of a closure across the expanse of the joint footprint. The first member and second member cooperate to establish a via substantially at the boundary, which via is of appropriate dimension to accept application of a weather-sealing material to establish a weather-resistant barrier at the boundary.

28 Claims, 7 Drawing Sheets

JOINT ADAPTABLE FOR USE IN A CLOSURE AND CLOSURE INCLUDING SUCH JOINT

BACKGROUND OF THE INVENTION

The present invention is directed to a joint adaptable for use in a closure, and a closure employing such a joint. Various types of closures, such as windows and doors, employ an array of cross-pieces to present a support matrix for receiving panels in the closure. Such panels may be wood panels but, more commonly, are glass panels such as the sort encountered in French doors, or the like.

Generally, such closures are bounded by horizontal stiles and vertical muntin bars, copingly fitted together. Within the boundary established by the stiles and muntin bars is a lattice, or matrix, of horizontal copes and vertical sticks. Each of the copes and sticks is similarly constructed having a decorative curved cap portion and, depending substantially perpendicularly from the cap portion, a base portion; the base portion is integrally formed with the cap portion.

The cap portions of the copes are copingly fitted to the ca portions of the sticks to present a nicely fitting decorative exterior joint at each intersection of a cope and a stick. The base portions may be joined by a butt joint, a mortise and tenon joint, a groove and tenon joint, or other commonly known joint structures.

The undersides of the respective cap portions of the copes and sticks are generally planar and present a support matrix for nestingly receiving glass panes or other panels which comprise the remainder of the closure. A glazing compound or other suitable fluid-resistant material is generally applied to the support matrix at the undersides of the respective cap portions in order to weather-seal the inside of the closure from the outside of the closure.

The coped fitting of the respective copes and sticks establishes a joint footprint having an expanse at the intersection between the respective copes and sticks. In order that the exterior appearance of the various joints between copes and sticks may be attractive, no glazing compound or other fluid-resistant material is generally applied in the areas of the joint footprints. Application of such fluid-resistant materials to a joint footprint in amounts appropriate to seal the joint against fluid incursion would likely result in a squeezing of the fluid-resistant material from between the cope and stick during assembly of the closure. Since such fluid-resistant material is generally messy, difficult to clean up, and resists stain, paint, or other finishes, the cosmetic appearance of the exterior of the closure would be undesirably affected by the presence of such fluid-resistant material.

Moreover, attempts to apply such fluid-resistant materials to the joint footprints in a production volume operation virtually guarantees a reduction of yield of acceptable-appearing closures. This is especially so when a closure may involve 10, 20, or more such joint footprints, and only one messy footprint would suffice to cause rejection of a closure.

Accordingly, there is an inherent leak path established from the exterior to the interior of the closure across the joint footprint area. So far as Applicant is aware, this established, inherent leak path across the joint footprint established between each of the cope and stick members, as well as across a similar joint footprint established between the aforementioned rail and muntin bar members, has been a problem in the closure art for approximately one hundred thirty-five years and has precluded the employment of such paned closures as employ such joint structures in areas where they would be subjected to weather.

The present invention is a joint adaptable for use in a closure, and a closure employing such a joint, which facilitates the application of fluid-resistant material appropriately to block incursion of fluids, such as rain water, across the joint footprint to the interior of the closure. Accordingly, for the first time known to Applicant, paned closures, such as French doors or similarly constructed windows, can be used in exterior applications without the massive leakage which has previously attended exterior employment of such paned closures.

SUMMARY OF THE INVENTION

The invention is a joint adaptable for use in a closure, and a closure employing such a joint, which joint comprises a first member and a second member, the first member substantially copingly fitting the second member and establishing a boundary between the inside and outside of a closure across the expanse of a joint footprint. The first member and second member cooperate to establish a pass substantially at the boundary, which pass is of appropriate dimension to accept application of a fluid-resistant material to establish a weather-sealing barrier at the boundary.

It is, therefore, an object of the present invention to provide a joint adaptable for use in a closure, and a closure employing such joint, which facilitates weather-resistant construction of closures.

A further object of the present invention is to provide a joint adaptable for use in a closure, and a closure employing such joint, which is weather-resistant yet generally indistinguishable in its cosmetic appearance from prior art closures.

Further objects and features of the present invention will be apparent from the following specification and claims when considered in connection with the accompanying drawings illustrating the preferred embodiment of the invention.

DETAILED DESCRIPTION OF THE DRAWINGS

DETAILED DESCRIPTION OF THE INVENTION

Figure 1:
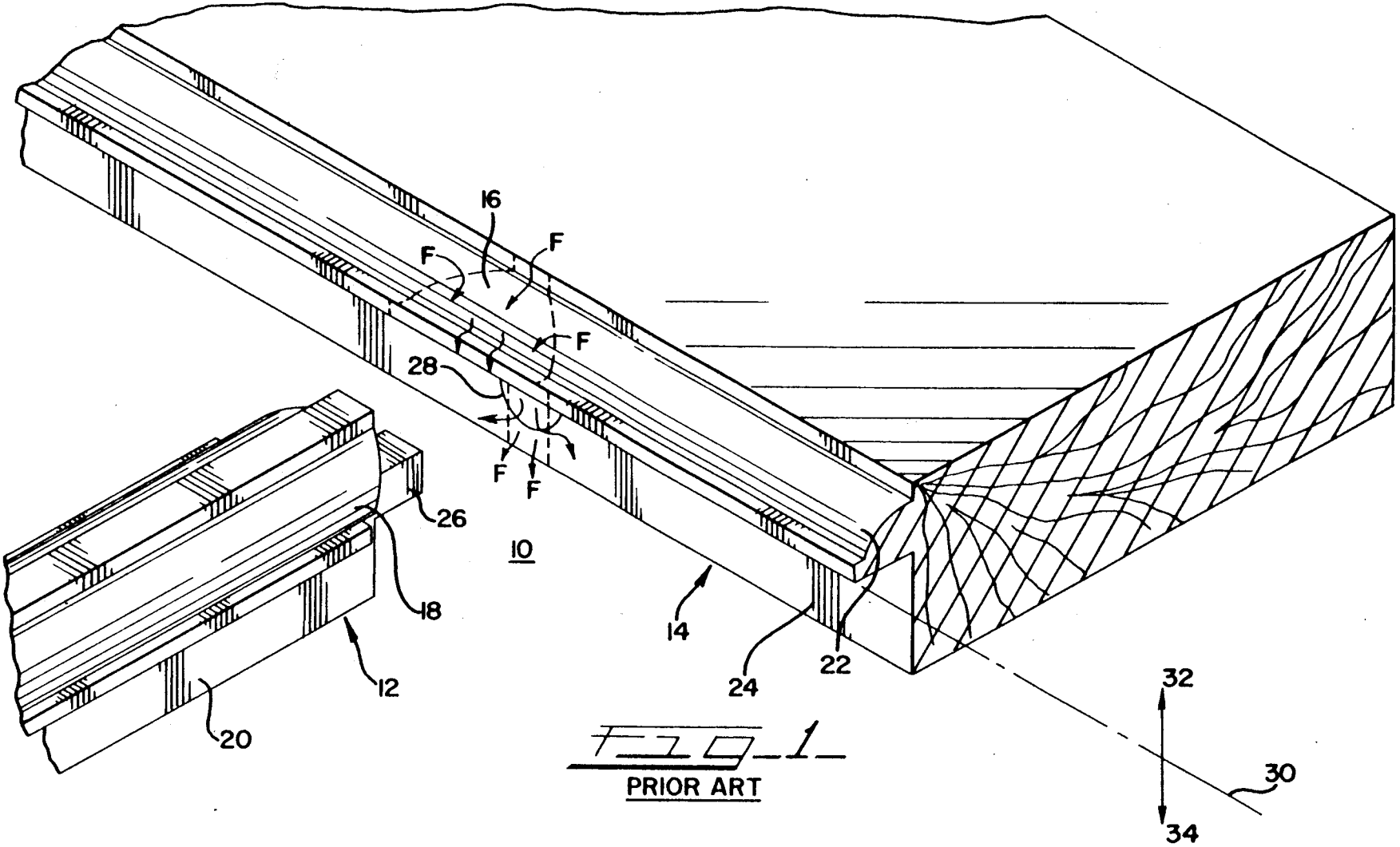
FIG. 1 PRIOR ART
FIG. 1 is a perspective exploded view illustrating the footprint of a joint according to the prior art, with identification of the inherent leak path established by such prior art joints.

In FIG. 1 is a perspective exploded view of a joint 10 according to the prior art. In FIG. 1, a cope member 12 is shown in exploded relationship with a stick member 14. Illustrated in phantom in FIG. 1 is a joint footprint 16 which delineates the expanse of intersection of cope member 12 with stick member 14 when joint 10 is fully assembled.

Cope member 12 is comprised of a cap portion 18 which is aesthetically curved to present a pleasing appearance when joint 10 is fully assembled. Integrally formed with and depending from cap portion 18 is a base portion 20.

Associated with stick member 14 is a cap portion 22 which is decoratively shaped in a manner similar to cap portion 18 of cope member 12. Further associated with stick member 14 is a base portion 24 depending from cap portion 22.

Associated with base portion 20 of cope member 12 is a tenon 26 which is appropriately shaped and positioned to be received within a mortise 28 in base portion 24 of stick member 14.

When joint 10 is assembled, cope member 12 and stick member 14 cooperate to establish a boundary 30 between the outside 32 and the inside 34 of joint 10 (or, of a closure employing joint 10). When joint 10 is assembled, a leak path is inherently present across the expanse of joint footprint 16, as indicated by the various flow arrows F in FIG. 1.

Figure 2:
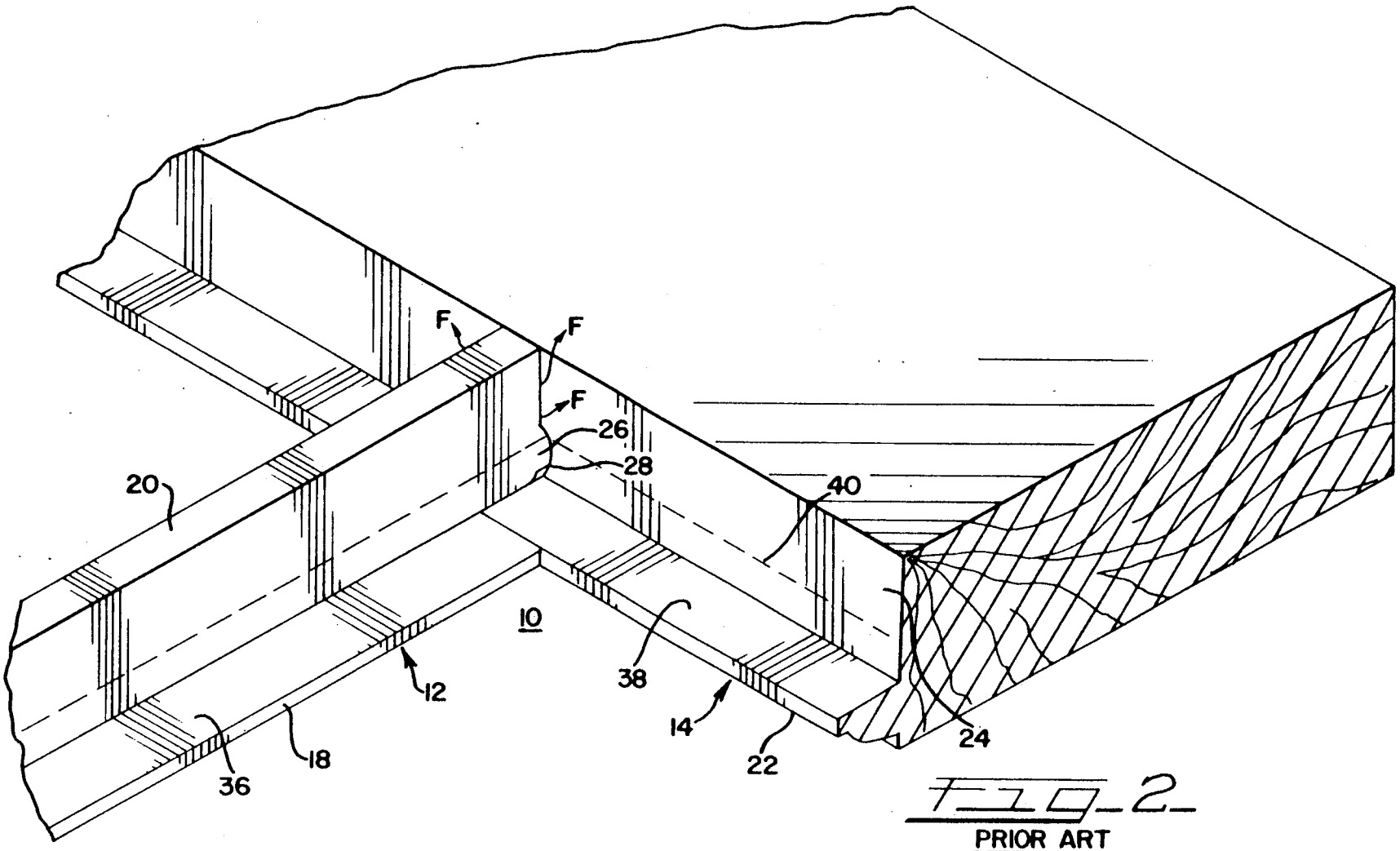
FIG. 2 PRIOR ART
FIG. 2 is a perspective view of the prior art joint illustrated in FIG. 1, taken from the bottom of the joint with the joint assembled.

FIG. 2 is a perspective view of an assembled joint 10 viewed from the bottom according to the prior art. Accordingly, in FIG. 2, cope member 12 having a cap portion 18 and a depending base portion 20 abut a stick portion 14 with its respective cap portion 22 and depending base portion 24. Base portion 20 joins base portion 24 by a tenon 26 inserted within a mortise 28. The inherent leak path across the joint footprint (not visible in FIG. 2) is shown by flow arrows F as they emerge from joint 10. More easily visible in FIG. 2 is the bottom planar flange 36 associated with cap portion 18 of cope member 12 and the bottom planar flange 38 associated with cap portion 22 of stick member 14. It is against these flanges 36, 38 that a pane or other panel (not shown) is nestingly engaged in an assembled closure employing joint 10. A representative thickness of a panel or pane is indicated in its nestedly engaged position in FIG. 2 by broken line 40.

Figure 3:
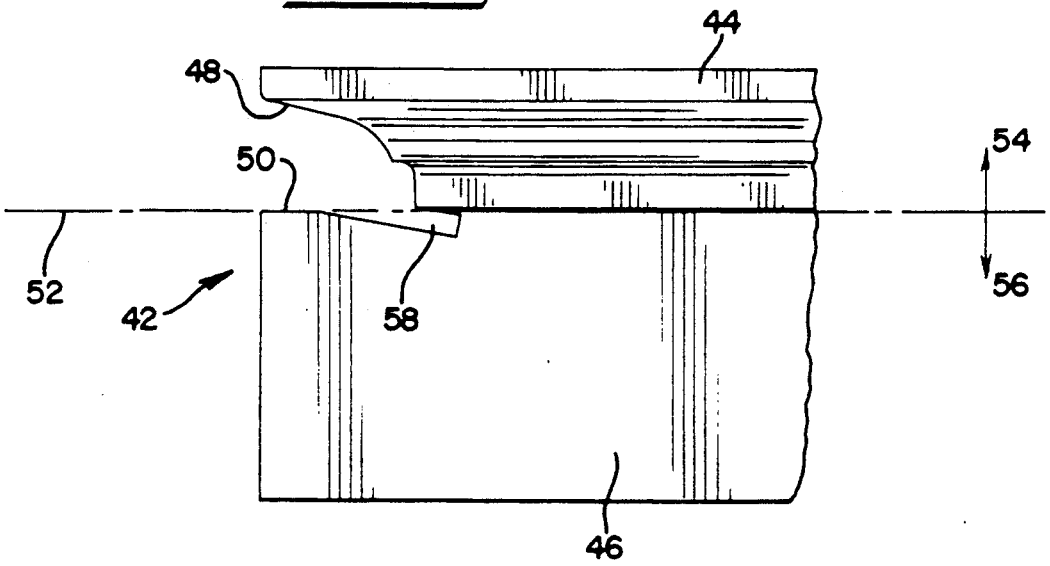
FIG. 3 is a side view of a portion of a cope employing the preferred embodiment of the present invention.

FIG. 3 is a side view of a portion of a cope member 42 according to the preferred embodiment of the present invention. In FIG. 3, cope member 42 is comprised of a cap portion 44 and, depending from cap portion 44, is a base portion 46. Cap member 44 is coped to closely fit a stick portion (not shown) along edge 48 in a manner whereby the cap portion of an associated stick member would nestingly rest against edge 48, and its respective lower flange (not shown in FIG. 3) would rest against ledge 50 of base portion 46. Accordingly, there would be established a boundary 52 between outside 54 and inside 56 of a closure employing a joint using cope member 42 of FIG. 3. When the joint is in an assembled orientation, a pass 58 is established in cope member 42 at the intersection of cope member 42 and its associated nested stick member (not shown in FIG. 3) substantially at boundary 52. Pass 58 is of appropriate dimension to receive fluid-resistant material (not shown) across the full expanse of intersection between cope member 42 and its associated stick member in the assembled joint. In such manner, a weather-resistant barrier of a fluid-resistant material is established at boundary 52.

Figure 4:
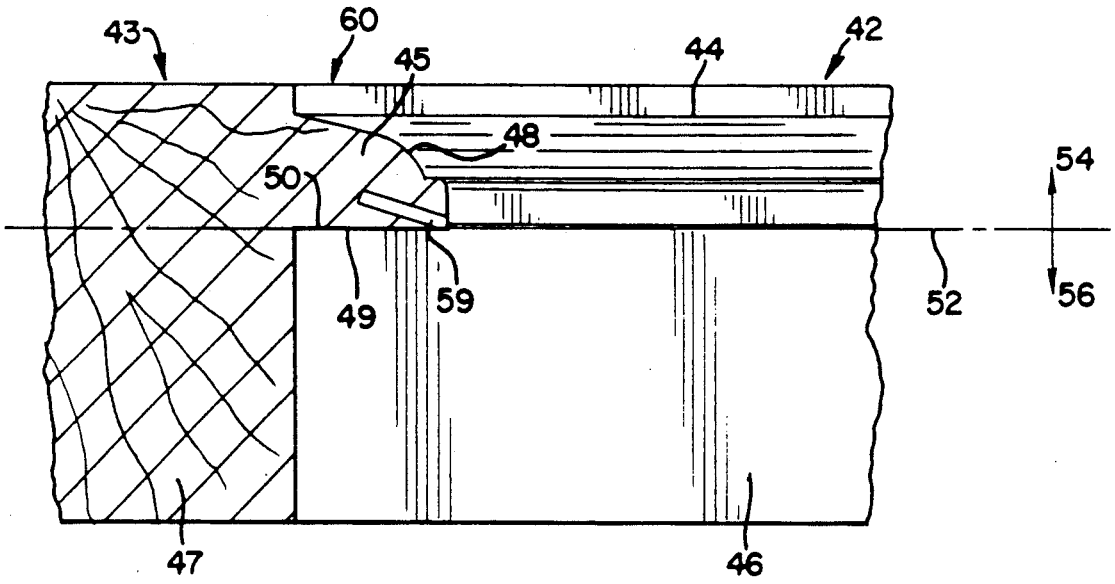
FIG. 4 is a side view of a cope and stick joint, with the stick shown in section, illustrating an alternate embodiment of the present invention.

FIG. 4 illustrates an alternate embodiment of the present invention where a pass is established in the stick member associated with the joint. In FIG. 4, a joint 60 is comprised of a cope member 42 and an associated stick member 43 (shown in section in FIG. 4). Cope member 42 has a cap portion 44 and a depending base portion 46; stick member 43 has a cap portion 45 and a depending base portion 47. Stick member 43 and cope member 42 nestingly abut at edge 48 of cope member 42 with the lower flange 49 of cap portion 45 of stick member 43 resting against ledge 50, and a boundary 52 established between outside 54 and inside 56. A pass 59 is established at boundary 52 across the expanse of cap portion 44 of cope member 42 by removing material from cap portion 45 of stick member 43.

In the preferred embodiment illustrated in FIG. 3 and in the alternate embodiment illustrated in FIG. 4, the respective passes 58, 59 are preferably established by a saw and therefore comprise a saw kerf.

Figure 5:
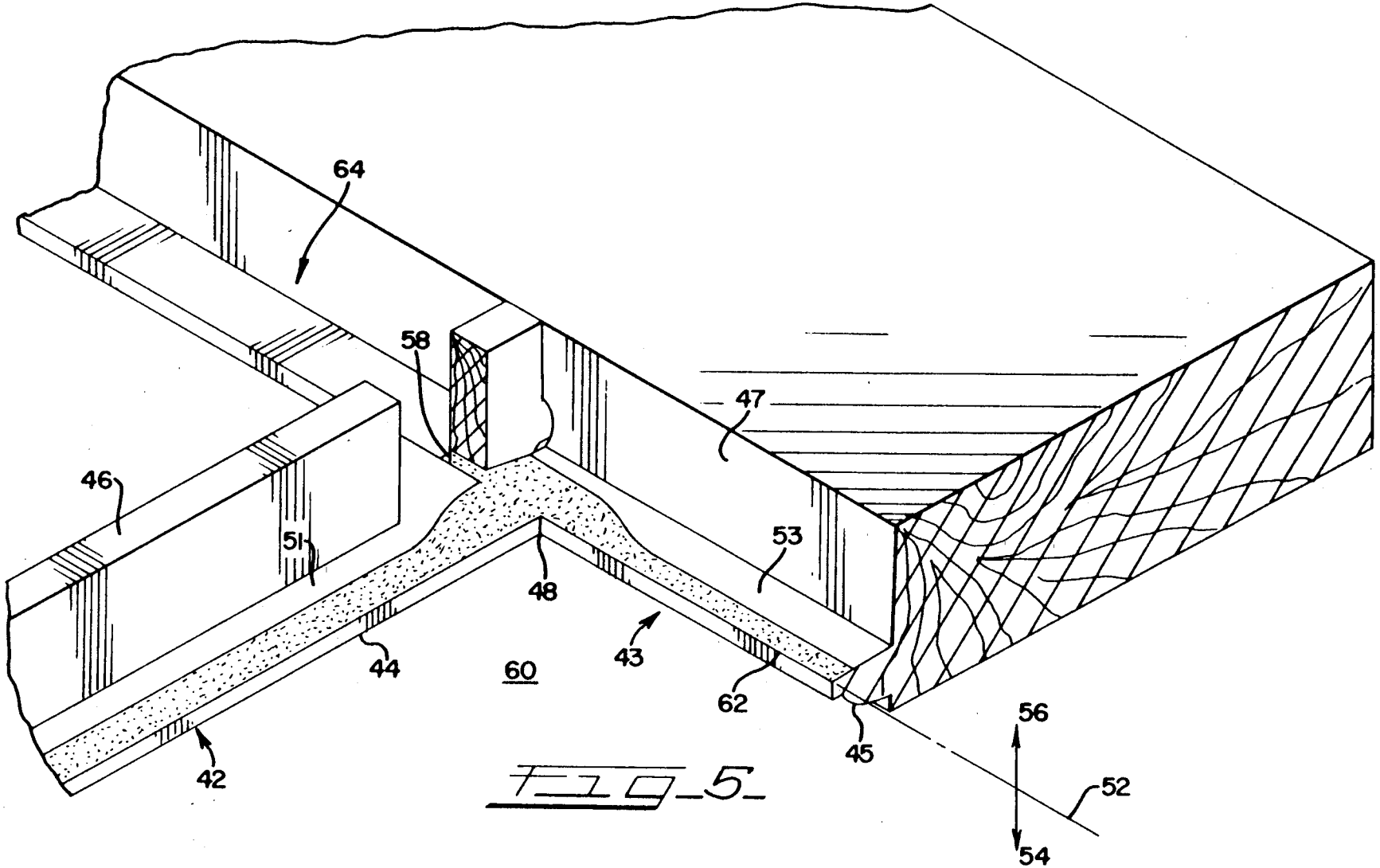
FIG. 5 is a perspective view in partial section from the bottom of an assembled joint, similar to the view in FIG. 1, illustrating the preferred embodiment of the present invention.

FIG. 5 is a perspective view, in partial section, of the bottom of an assembled joint employing the preferred embodiment of the present invention. In FIG. 5, a joint 60 is comprised of a cope member 42 and a stick member 43. Cope member 42 has a cap portion 44 and a depending base portion 46. Stick portion 43 has a cap portion 45 and a depending base portion 47. Cope member 42 and stick member 43 meet at edge 48 and establish boundary 52 between outside 54 and inside 56 of joint 60. A bed of fluid-resistant material 62 is laid on the flange 51 of cope member 42 and the flange 53 of stick member 43 to establish a weather-resistant seal upon nesting engagement of a pane or panel (not shown) against flanges 51, 53. Fluid-resistant material 62 is also introduced within pass 58, thereby establishing a weather-resistant seal at boundary 52 across the expanse of base portion 46 where it abuts stick member 43. Not shown in FIG. 5 for purposes of clarity of presentation, however, is a complementary bed of fluid-resistant material in the next adjacent section 64 established by joint 60 for nested reception of a second pane (not shown). Thus, as a practical matter, fluid-resistant material 62 will extend across the full expanse of abutment between cope member 42 and stick member 43.

Figure 6:
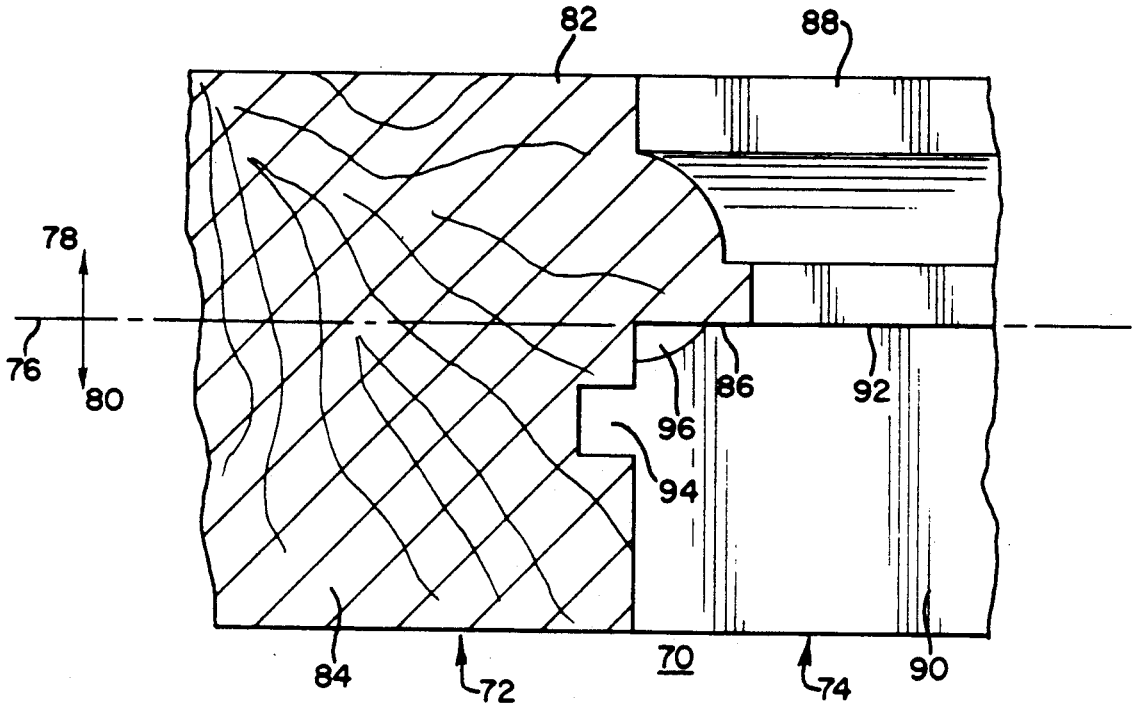
FIG. 6 is a side view of an assembled cope and stick joint, with the stick shown in section, having a mortise and tenon structure illustrating a second alternate embodiment of the present invention.

FIG. 6 is a side view of an assembled joint 70 comprised of a stick member 72 (shown in section in FIG. 6) copingly engaged by a cope member 74 and establishing a boundary 76 between outside 78 and inside 80 of joint 70. Stick member 72 is comprised of a cap portion 82 and a depending base portion 84 and presents a flange 86 at the underside of cap portion 82. Cope member 74 is comprised of a cap portion 88 and a depending base portion 90 and presents a flange 92 at the bottom of cap portion 88. Joint 70 of FIG. 6 employs a modified mortise and tenon connection 94 between cope member 74 and stick member 72. A pass 96 is established by removing material from base portion 90 of cope member 74 across the expanse of cope member 74.

Figure 7:
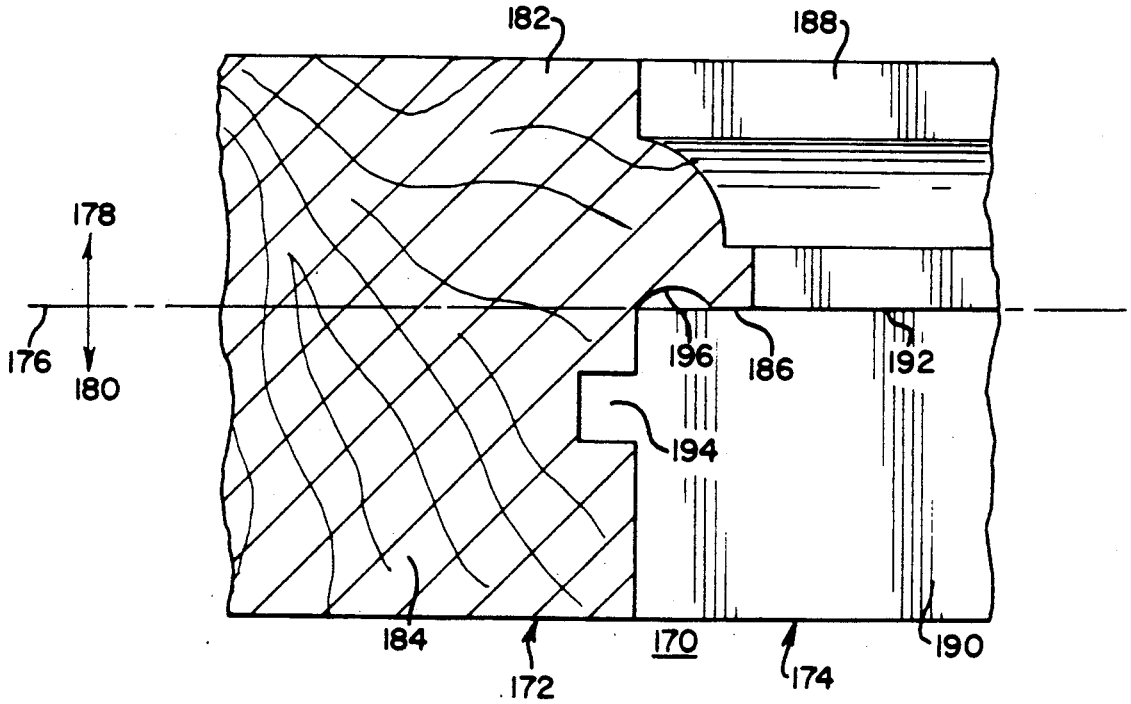
FIG. 7 is a side view of an assembled cope and stick joint, with the stick shown in section, having a mortise and tenon structure illustrating another alternate embodiment of the present invention.

FIG. 7 is a side view of an assembled joint 170 comprised of a stick member 172 (shown in section in FIG. 7) copingly engaged by a cope member 174 and establishing a boundary 176 between outside 178 and inside 180 of joint 170. Stick member 172 is comprised of a cap portion 182 and a depending base portion 184 and presents a flange 186 at the underside of cap portion 182. Cope member 174 is comprised of a cap portion 188 and a depending base portion 190 and presents a flange 192 at the bottom of cap portion 188. Joint 170 of FIG. 7 employs a modified mortise and tenon connection 194 between cope member 174 and stick member 172. A pass 196 is formed by removing material from stick member 172 across the expanse of cope member 174.

Figure 8:
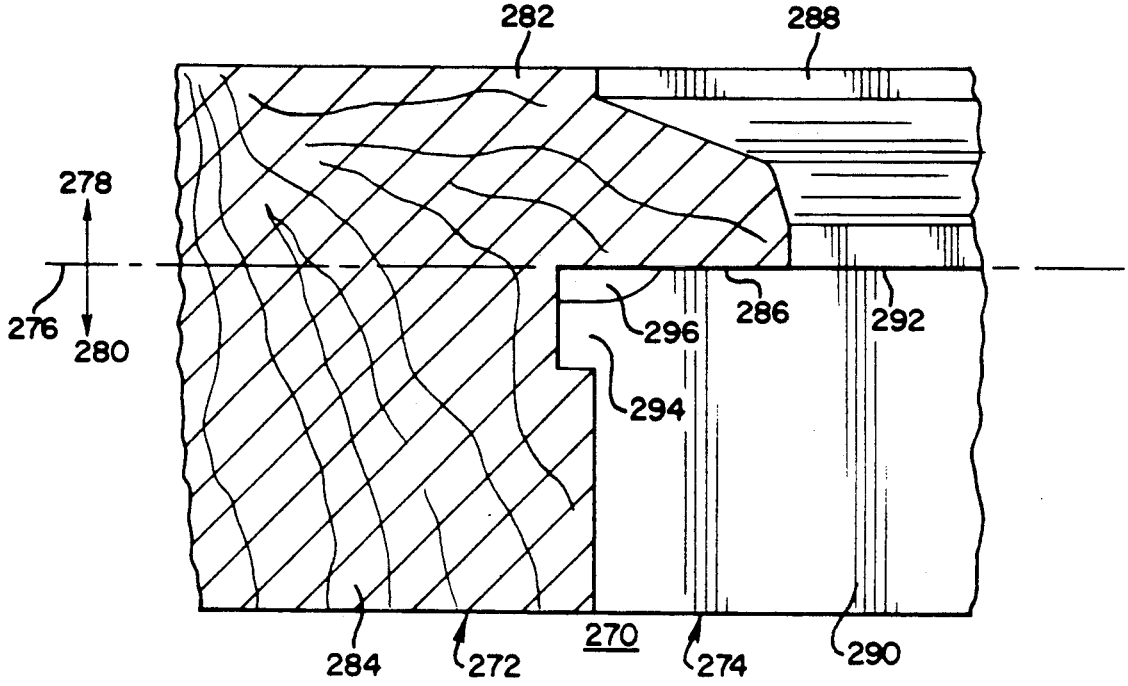
FIG. 8 is a side view of an assembled cope and stick joint, with the stick shown in section, having a groove and tenon structure illustrating yet another alternate embodiment of the present invention.

FIG. 8 is a side view of an assembled joint 270 comprised of a stick member 272 (shown in section in FIG. 8) copingly engaged by a cope member 274 and establishing a boundary 276 between outside 278 and inside 280 of joint 270. Stick member 272 is comprised of a cap portion 282 and a depending base portion 284 and presents a flange 286 at the underside of cap portion 282. Cope member 274 is comprised of a cap portion 288 and a depending base portion 290 and presents a flange 292 at the bottom of cap portion 288. Joint 270 of FIG. 8 employs a groove and tenon connection 294 between cope member 274 and stick member 272. A pass 296 is established by removing material from base portion 290 of cope member 274 across the expanse of cope member 274.

Figure 9:
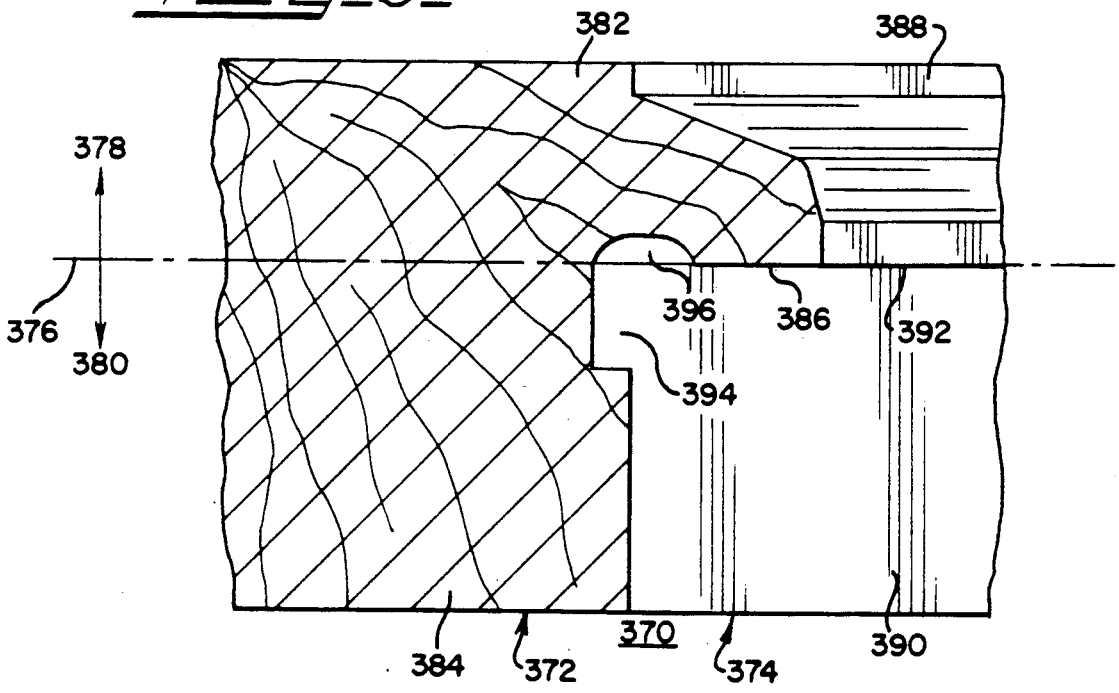
FIG. 9 is a side view of an assembled cope and stick joint, with the stick shown in section, having a groove and tenon structure illustrating still another alternate embodiment of the present invention.

FIG. 9 is a side view of an assembled joint 370 comprised of a stick member 372 (shown in section in FIG. 9) copingly engaged by a cope member 374 and establishing a boundary 376 between outside 378 and inside 380 of joint 370. Stick member 372 is comprised of a cap portion 382 and a depending base portion 384 and presents a flange 386 at the underside of cap portion 382. Cope member 374 is comprised of a cap portion 388 and a depending base portion 390 and presents a flange 392 at the bottom of cap portion 388. Joint 370 of FIG. 9 employs a groove and tenon connection 394 between cope member 374 and stick member 372. A pass 396 is established by removing material from stick member 372 across the expanse of cope member 374.

Figure 10:
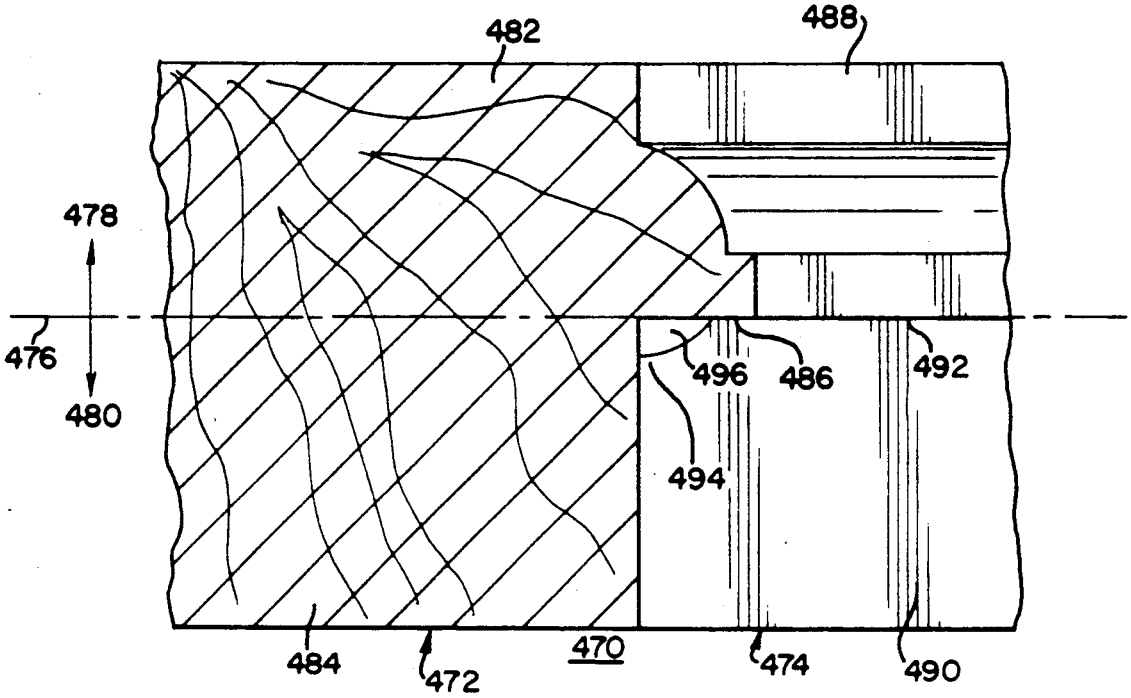
FIG. 10 is a side view of an assembled cope and stick joint, with the stick shown in section, having a butt joint structure illustrating a further alternate embodiment of the present invention.

FIG. 10 is a side view of an assembled joint 470 comprised of a stick member 472 (shown in section in FIG. 10) copingly engaged by a cope member 474 and establishing a boundary 476 between outside 478 and inside 480 of joint 470. Stick member 472 is comprised of a cap portion 482 and a depending base portion 484 and presents a flange 486 at the underside of cap portion 482. Cope member 474 is comprised of a cap portion 488 and a depending base portion 490 and presents a flange 492 at the bottom of cap portion 488. Joint 470 of FIG. 10 employs a butt connection 494 between cope member 474 and stick member 472. A via 496 is established by removing material from base portion 490 of cope member 474 across the expanse of cope member 474.

Figure 11:
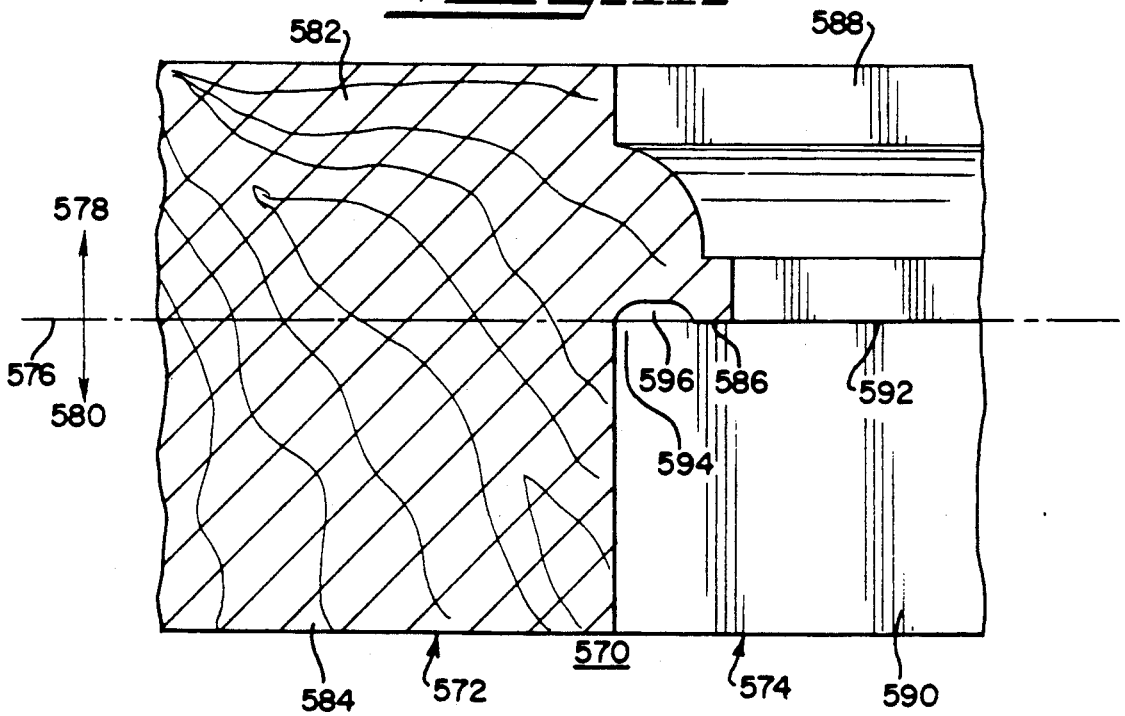
FIG. 11 is a side view of an assembled cope and stick joint, with the stick shown in section, having a butt joint structure illustrating a still further alternate embodiment of the present invention.

FIG. 11 is a side view of an assembled joint 570 comprised of a stick member 572 (shown in section in FIG. 11) copingly engaged by a cope member 574 and establishing a boundary 576 between outside 578 and inside 580 of joint 570. Stick member 572 is comprised of a cap portion 582 and a depending base portion 584 and presents a flange 586 at the underside of cap portion 582. Cope member 574 is comprised of a cap portion 588 and a depending base portion 590 and presents a flange 592 at the bottom of cap portion 588. Joint 570 of FIG. 11 employs a butt connection 594 between cope member 574 and stick member 572. A pass 596 is established by removing material from stick member 572 across the expanse of cope member 574.

It is to be understood that, while the detailed drawings and specific examples given describe preferred embodiments of the invention, they are for the purpose of illustration only, that the apparatus of the invention is not limited to the precise details and conditions disclosed and that various changes may be made therein without departing from the spirit of the invention which is defined by the following claims.

We claim:

1. A joint adaptable for use in a closure, said closure having an inside and an outside, the joint comprising a first member and a second member, said first member substantially copingly fitting said second member across an expanse; said first member and said second member cooperating to establish a boundary between said inside and said outside across said expanse; said first member and said second member further cooperating to establish a pass substantially at said boundary, said pass being of appropriate dimension to accept application of a weather-sealing material to establish a weather-resistant barrier at said boundary.

2. A joint adaptable for use in a closure as recited in claim 1 wherein said first member and said second member further fitting by a mortise and tenon structure, said mortise and tenon structure being located at said inside.

3. A joint adaptable for use in a closure as recited in claim 1 wherein said first member and said second member each presents an inward facing surface appropriate to peripherally support an insert member, said insert member partitioning said inside from said outside.

4. A joint adaptable for use in a closure as recited in claim 1 wherein said pass is established by said first member.

5. A joint adaptable for use in a closure as recited in claim 1 wherein said pass is established by said second member.

6. A joint adaptable for use in a closure as recited in claim 4 wherein said pass comprises a kerf.

7. A joint adaptable for use in a closure as recited in claim 5 wherein said pass comprises a kerf.

8. A closure, said closure having an inside and an outside and comprising a plurality of first support members, a plurality of second support members, at least one insert member, and a fluid resistant material; said plurality of first support members and said plurality of second support members cooperating to present a support matrix; said at least one insert member being nestingly peripherally retained by said support matrix; said fluid resistant material being compressively retained intermediate said at least one insert member and said support matrix; said plurality of first support members and said plurality of second support members meeting in a plurality of joints, at each respective joint of said plurality of joints a primary support member substantially copingly fitting a secondary support member; said primary support member being a respective of one of said plurality of first support members or said plurality of second support members meeting at said respective joint, and said second support member being the respective other of said plurality of first support members or said plurality of second support members meeting at said respective joint, said fitting occurring across an expanse and establishing a boundary between said inside and said outside across said expanse; said primary support member and said secondary support member cooperating to establish a pass substantially at said boundary, said pass extending across said expanse and accommodating application of said fluid resistant material to establish a fluid resistant barrier at said boundary.

9. A closure as recited in claim 8 wherein said pass is established by said primary support member.

10. A closure as recited in claim 8 wherein said pass is established by said secondary support member.

11. A closure as recited in claim 9 wherein said pass comprises a kerf.

12. A closure as recited in claim 10 wherein said pass comprises a kerf.

13. A joint for facilitating preassembly of a support matrix for use in assembling a weather-resistant closure; said support matrix being comprised of a plurality of first support members, said support matrix being configured to nestingly peripherally retain a plurality of insert members with a fluid resistant material compressively retained intermediate each of said plurality of insert members and said support matrix when said closure is assembled; said closure having an inside and an outside; said plurality of first support members and said plurality of second support members meeting in a plurality of intersections, each of said plurality of intersections employing the joint, the joint comprising:

a primary member and a secondary member, said primary member being one of said plurality of first support members or of said plurality of second support members at a particular intersection of said plurality of intersections, said secondary member being the other of said plurality of first support members or of said plurality of second support members or of said plurality of second support members at said particular intersection; said primary member substantially copingly fitting said secondary member across an expanse; said primary member and said secondary member cooperating to establish a boundary between said inside and said outside across said expanse; said primary member and said secondary member further cooperating to establish a pass substantially at said boundary, said pass being of appropriate dimension to accept said fluid resistant material across said boundary during assembly of said closure.

14. A joint for facilitating preassembly of a support matrix for use in assembling a weather-resistant closure as recited in claim 13 wherein said pass is established by said primary support member.

15. A joint for facilitating preassembly of a support matrix for use in assembling a weather-resistant closure as recited in claim 13 wherein said via is established by said second support member.

16. A joint for facilitating preassembly of a support matrix for use in assembling a weather-resistant closure as recited in claim 14 wherein said via comprises a kerf.

17. A joint for facilitating preassembly of a support matrix for use in assembling a weather-resistant closure as recited in claim 15 wherein said via comprises a kerf.

18. A support matrix configured for receiving a plurality of insert members to form a closure assembly, said closure assembly having an inside and an outside and including a fluid resistant material compressively retained intermediate each of said plurality of insert members and the support matrix; each of said plurality of insert members being nestingly peripherally retained by the support matrix in said closure assembly; the support matrix comprising:

a plurality of first support members and a plurality of second support members, said plurality of first support members and said plurality of second support members meeting in a plurality of joints, at each respective joint of said plurality of joints a primary support member substantially copingly fitting a secondary support member; said primary support member being a respective of one of said plurality of first support members or said plurality of second support members meeting at said respective joint, and said secondary support member being the respective other of said plurality of first support members or said plurality of second support members meeting at said respective joint, said fitting occurring across an expanse and establishing a boundary between said inside and said outside across said expanse; said primary support member and said secondary support member cooperating to establish a pass substantially at said boundary, said pass extending across said expanse and accommodating said fluid resistant material across said expanse during assembling said closure assembly to establish a fluid-resistant barrier at said boundary.

19. A support matrix configured for receiving a plurality of insert members to form a closure assembly as recited in claim 18 wherein said pass is established by said primary support member.

20. A support matrix configured for receiving a plurality of insert members to form a closure assembly as recited in claim 18 wherein said via is established by said second support member.

21. A support matrix configured for receiving a plurality of insert members to form a closure assembly closure as recited in claim 19 wherein said via comprises a kerf.

22. A support matrix configured for receiving a plurality of insert members to form a closure assembly closure as recited in claim 20 wherein said via comprises a kerf.

23. A joint for use in a closure, said closure having an inside and an outside, the joint comprising a first member and a second member, said first member substantially copingly fitting said second member across an expanse; said first member and said second member cooperating to establish a boundary between said inside and said outside across said expanse; said first member and said second member further cooperating to establish a pass substantially at said boundary, said pass being of appropriate dimension to accept application of a weather-sealing material to establish a weather-resistant barrier at said boundary; said first member sand said second member further fitting by a mortise and tenon structure, said mortise and tenon structure being located at said inside.

24. A joint adaptable for use in a closure as recited in claim 23 wherein said first member and said second member each presents an inward facing surface appropriate to peripherally support an insert member, said insert member partitioning said inside from said outside.

25. A joint adaptable for use in a closure as recited in claim 23 wherein said via is established by said first member.

26. A joint adaptable for use in a closure as recited in claim 23 wherein said via is established by said second member.

27. A joint adaptable for use in a closure as recited in claim 25 wherein said via comprises a kerf.

28. A joint adaptable for use in a closure as recited in claim 26 wherein said via comprises a kerf.

* * * * *